US012108839B2

(12) United States Patent
Garbujo et al.

(10) Patent No.: US 12,108,839 B2
(45) Date of Patent: Oct. 8, 2024

(54) LOWER SHELL FOR A GLIDING BOOT

(71) Applicant: ROSSIGNOL LANGE S.R.L., Montebelluna (IT)

(72) Inventors: Giuseppe Garbujo, Montebelluna (IT); Danilo Frada, Montebelluna (IT)

(73) Assignee: ROSSIGNOL LANGE S.R.L., Montebelluna (IT)

( * ) Notice: Subject to any disclaimer, the term of this patent is extended or adjusted under 35 U.S.C. 154(b) by 0 days.

(21) Appl. No.: 17/869,259

(22) Filed: Jul. 20, 2022

(65) Prior Publication Data

US 2023/0024907 A1 Jan. 26, 2023

(30) Foreign Application Priority Data

Jul. 21, 2021 (EP) ..... 21425034
Jan. 31, 2022 (FR) ..... 2200801

(51) Int. Cl.
*A43B 5/04* (2006.01)

(52) U.S. Cl.
CPC ..... *A43B 5/0456* (2013.01); *A43B 5/0433* (2013.01); *A43B 5/0482* (2013.01)

(58) Field of Classification Search
CPC ... A43B 5/0452; A43B 5/0454; A43B 5/0456; A43B 5/0458; A43B 5/046; A43B 5/0462; A43B 5/0464; A43B 5/0468
See application file for complete search history.

(56) References Cited

U.S. PATENT DOCUMENTS 3,945,134 A * 3/1976 Ramer ..... A43B 5/0496 36/118.4
4,447,970 A * 5/1984 Delery ..... A43B 5/0456 36/118.3
4,962,594 A * 10/1990 Marega ..... A43B 5/0456 36/118.8
5,819,441 A * 10/1998 Perrissoud ..... A43B 5/0456 36/119.1
5,832,635 A * 11/1998 Finney ..... A43B 7/20 36/118.8
5,909,885 A * 6/1999 Borel ..... A43B 5/0482 280/11.233
6,026,594 A 2/2000 Fougere
(Continued)

FOREIGN PATENT DOCUMENTS

IT VR20090068 A1 11/2010
IT TV20110084 A1 12/2012
WO 2014064657 A1 5/2014

OTHER PUBLICATIONS

EP Search Report and Written Opinion dated Dec. 17, 2021 in priority application No. EP21425034; w/ English machine translation (total 14 pages).

*Primary Examiner* — Sharon M Prange
(74) *Attorney, Agent, or Firm* — Seckel IP, PLLC

(57) ABSTRACT

Gliding boot (1) including a lower shell (2) and a collar (4), the lower shell (2) being intended to receive a user's foot, the collar (4) being intended to envelop a lower leg of the user, the collar being articulated in rotation about the lower shell, the gliding boot further including an upwardly extending tongue (10) to the rear of the gliding boot and an elastic means (26), a first end of the tongue being fastened to the lower shell (2), and a second end of the tongue (10) being connected to the collar (4) via the elastic means (26).

12 Claims, 6 Drawing Sheets

(56) References Cited

U.S. PATENT DOCUMENTS

| | | | | |
|---|---|---|---|---|
| 6,135,464 | A * | 10/2000 | Borel | A43B 5/1666<br>280/11.221 |
| 2002/0029497 | A1* | 3/2002 | Pierce | A43B 5/048<br>36/118.3 |
| 2013/0097892 | A1 | 4/2013 | Viniero et al. | |
| 2014/0215855 | A1 | 8/2014 | Frey | |
| 2015/0250257 | A1 | 9/2015 | Parisotto | |
| 2018/0070672 | A1* | 3/2018 | Parisotto | A43B 5/0496 |
| 2019/0082778 | A1* | 3/2019 | Zampieri | A43B 5/0468 |

* cited by examiner

LOWER SHELL FOR A GLIDING BOOT

This application claims priority of European Patent Office patent application No. EP21425034.2 filed Jul. 21, 2021, and this application claims priority of French patent application No. FR2200801 filed Jan. 31, 2022, the content of each of which is hereby incorporated by reference herein in its entirety.

TECHNICAL FIELD OF THE INVENTION

The invention relates to a gliding boot, in particular a ski boot, comprising a lower shell and a collar articulated in rotation about the lower shell.

BACKGROUND ART

Gliding sports are sports in which a user guides one or more gliding boards attached to his feet. For the practice of these sports, the variations in the terrain are felt at the feet and the lower legs via gliding boots. The gliding boots conventionally comprise a lower shell enveloping the user's foot and a collar enveloping the lower leg. The collar is articulated in rotation about the lower shell about an axis of rotation substantially aligned with an axis passing through the user's ankles. Gliding boots play a key role in the perception of the terrain by the user and in the impulses transmitted by him to the gliding board or boards.

Among the gliding sports, alpine skiing is a sport in which a user guides a pair of skis attached to his feet on a snow-covered terrain. When a skier makes a series of turns, he alternates between phases of bending and of extending his legs. During the bending phases, the collar pivots forwards with respect to the lower shell and, during extension phases, it pivots rearwards. In order to have good control over his skis, not only retaining characteristics but also elasticity, cushioning and rebound characteristics of the ski boots are sought so as to obtain guidance of the skis that is dynamic, precise and without excess effort.

The rebound of a ski boot characterizes its capacity to return to its initial position subsequent to forward bending of the collar. Manufacturers seek to increase the rebound of gliding boots. For this purpose, gliding boots have been proposed in patent U.S. Pat. No. 6,026,594 that comprise an elastic strap able to produce a substantially constant pressure on the user's tibia. This pressure makes it possible to maintain substantially constant tibial pressing on the gliding boot during the movement of bending/extending the legs and thus makes it possible to achieve better control of the skis. However, the rebound obtained with such gliding boots is still insufficient.

Moreover, gliding boots must also remain simple to use and to manufacture. The gliding boots known from the prior art do not make it possible to achieve all these requirements at the same time. In particular, the boots known from the prior art do not make it possible to guide one or more gliding boards in a sufficiently dynamic, efficient and precise manner.

PRESENTATION OF THE INVENTION

The aim of the invention is to provide a gliding boot that overcomes the above disadvantages and improves the gliding boots known from the prior art.

More precisely, one subject of the invention is a gliding boot that is simple to manufacture, durable and offers optimal rebound characteristics for guiding one or more gliding boards.

SUMMARY OF THE INVENTION

The invention relates to a gliding boot comprising a lower shell and a collar, the lower shell being intended to receive a user's foot, the collar being intended to envelop a lower leg of the user, the collar being articulated in rotation about the lower shell, the gliding boot further comprising an upwardly extending tongue to the rear of the gliding boot and an elastic means, a first end of the tongue being fastened to the lower shell, and a second end of the tongue being connected to the collar via the elastic means.

The elastic means can be configured to produce an elastic return force in the direction in which the tongue extends.

The elastic means can be configured to be elastically compressed when the collar pivots forwards with respect to the lower shell.

The elastic means can be an elastomer element.

The tongue can comprise an opening, the elastic means being positioned inside the opening.

The gliding boot can comprise an insert fastened directly to the collar, the elastic means comprising a first end bearing on the tongue and a second end bearing on the insert.

The insert can be clipped into the opening.

The tongue can be configured to be bent elastically when the collar pivots forwards with respect to the lower shell.

The tongue and the lower shell can be made of the same material, in particular the tongue and the lower shell can be made of polyurethane.

The tongue can form a monobloc assembly with the lower shell.

The invention also relates to a lower shell for a gliding boot comprising an enveloping part intended to receive a user's foot, comprising a tongue which is monobloc with the enveloping part and extends substantially from a rear wall of the enveloping part and upwards, the tongue being intended to cooperate with a collar articulated in rotation about the enveloping part.

The enveloping part can extend to above the user's ankles, and the tongue can be connected to the enveloping part substantially at the height of the ankles.

The tongue can comprise at least one stiffening rib the thickness of which decreases as it runs along the tongue from bottom to top.

The tongue can extend above the enveloping part.

The lower shell can be obtained by plastic injection moulding, in particular by polyurethane injection moulding.

The tongue can comprise a generally rectangular shape, a height of the tongue being between 5 cm and 20 cm, and/or a width of the tongue being between 5 mm and 30 mm.

The lower shell according can comprise a space defined between the rear wall of the enveloping part and the tongue, a dimension of this space being between 2 mm and 15 mm.

The tongue can be generally forwardly inclined by an angle of between 5° and 20° with respect to a vertical axis.

The tongue can be configured to flex when the collar pivots forwards about the enveloping part.

The invention also relates to a gliding boot, comprising a lower shell as previously defined, the collar being articulated in rotation about the enveloping part, the tongue being connected to the collar.

The collar can comprise a rear wall covered by the tongue.

The collar can comprise an opening into which an upper end of the tongue is inserted.

The tongue can be fastened to the collar, in particular by means of at least one fastening screw.

The tongue can comprise an upper portion covered by a wall of the collar and a lower portion not covered by the collar.

The invention also relates to a collar for a gliding boot, comprising an enveloping part intended to receive a user's lower leg, comprising a tongue which is monobloc with the enveloping part and extends substantially from a rear wall of the enveloping part and downwards, the tongue being intended to cooperate with a lower shell articulated in rotation about the enveloping part.

PRESENTATION OF THE FIGURES

These objects, features and advantages of the present invention will be explained in detail in the following description of a nonlimiting particular embodiment with reference to the appended figures, in which.

DETAILED DESCRIPTION

Figure 1:
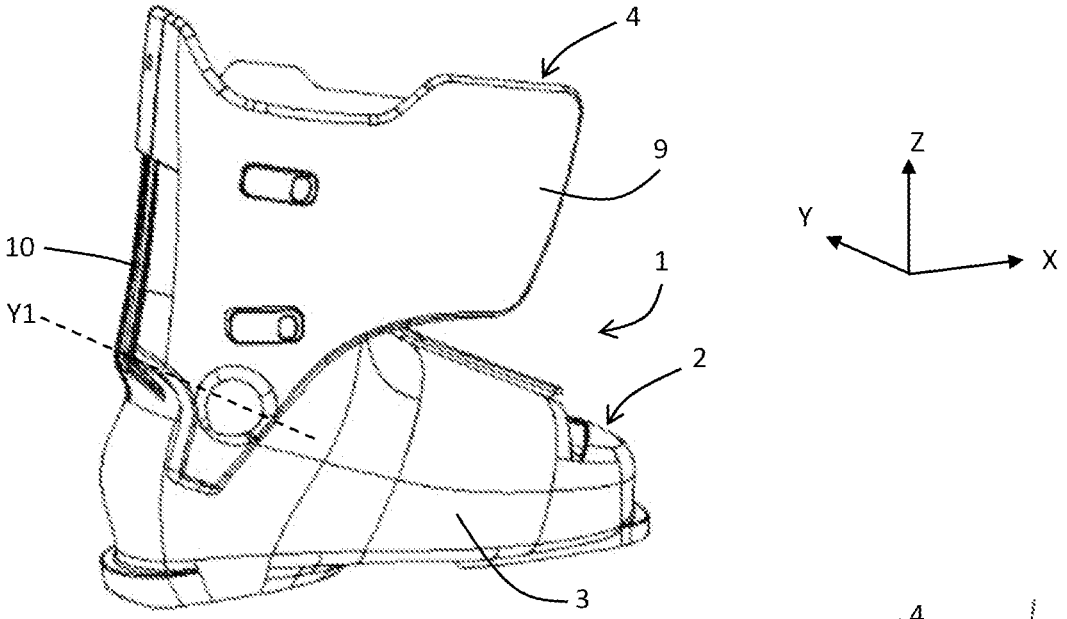
FIG. 1 is a three-dimensional view of a ski boot according to one embodiment of the invention.

FIG. 1 schematically illustrates a gliding boot 1 according to one embodiment of the invention. The gliding boot is a ski boot, in particular for alpine skiing. In a variant, the boot could be any boot intended to be used in any other gliding sport, that is to say a sport in which a user guides one or more gliding boards with his feet by performing bending and extension movements of his legs. For example, the gliding boot can be any other boot for gliding on snow, in particular a snowboard boot, a ski touring boot, or a cross-country ski boot.

For the requirements of the description, it will be considered that the boot rests by its sole on a horizontal ground. A longitudinal axis X is defined as being as an axis parallel to the axis in which the user's foot extends from the heel (at the rear) towards the toes (at the front). The transverse axis Y denotes an axis perpendicular to the longitudinal axis X and passing through the two ankles of the user. The axes X and Y are horizontal. The vertical axis Z is an axis perpendicular to the axes X and Y. The front and the rear are defined in relation to the longitudinal axis X: the front denotes a region more towards the toes, whereas the rear denotes a region more towards the heel. The top and the bottom are defined in relation to the vertical axis Z. An upper region denotes a region more towards the top and a lower region denotes a region more towards the bottom.

The gliding boot 1 comprises a lower shell 2 comprising an enveloping part 3 intended to receive, or in other words to envelop, the user's foot. The gliding boot 1 also comprises a collar 4 intended to envelop the lower leg of the user. The collar is articulated in rotation about the lower shell, and in particular about the enveloping part 3, about an axis Y1 substantially parallel to the transverse axis Y and passing through the two ankles of the user.

Figure 6:
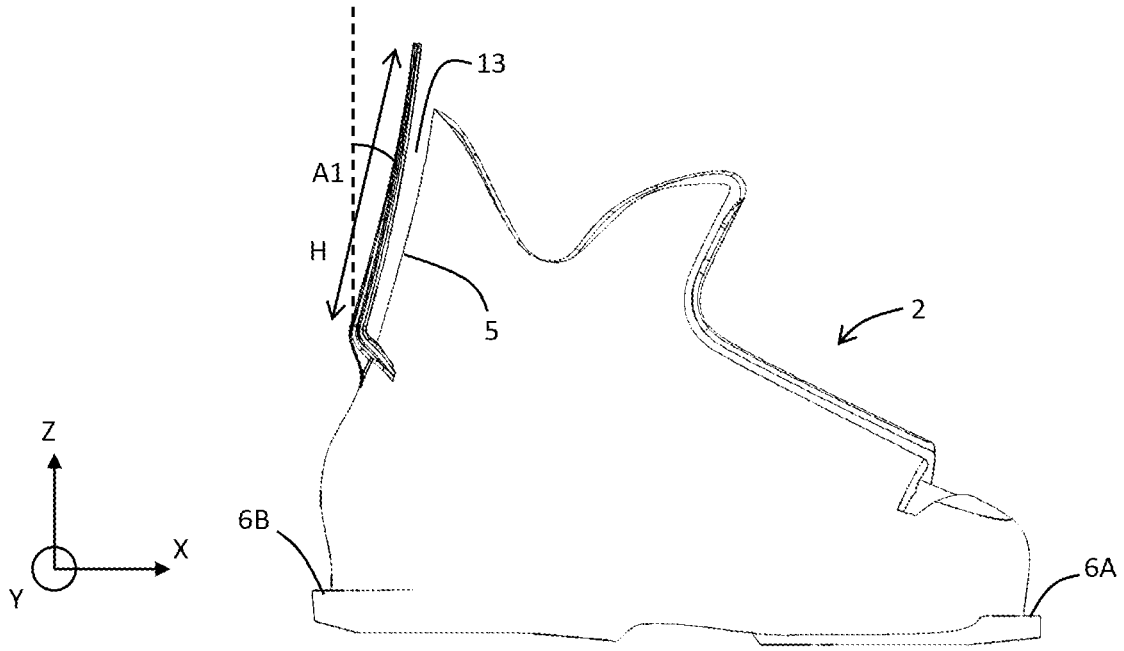
FIG. 6 is a side view of the ski boot.

The enveloping part 3 comprises a general shape which hugs the shape of the foot. It comprises in particular a rear wall 5 which hugs the shape of the heel and of the Achilles tendon. It also comprises curved lateral walls which hug the shape of the ankles. The rear wall extends vertically over the whole height of the lower shell and laterally substantially to the level of the ankles. As can be seen in FIG. 6, this rear wall 5 can comprise a generally forwardly inclined portion in order to promote bearing of the user's tibia on an opposite surface of the boot, that is to say on a front surface of the boot, in particular a front surface of the collar.

The lower shell 2 can also comprise fastening interfaces intended to cooperate with a fastening device of a gliding board. According to the embodiment presented, with the gliding boot being a ski boot, it comprises a front lip 6A and a rear lip 6B which are intended to cooperate with the jaws of a fastening device. In this case, the lips form at least part of the sole of the boot.

Figure 4:
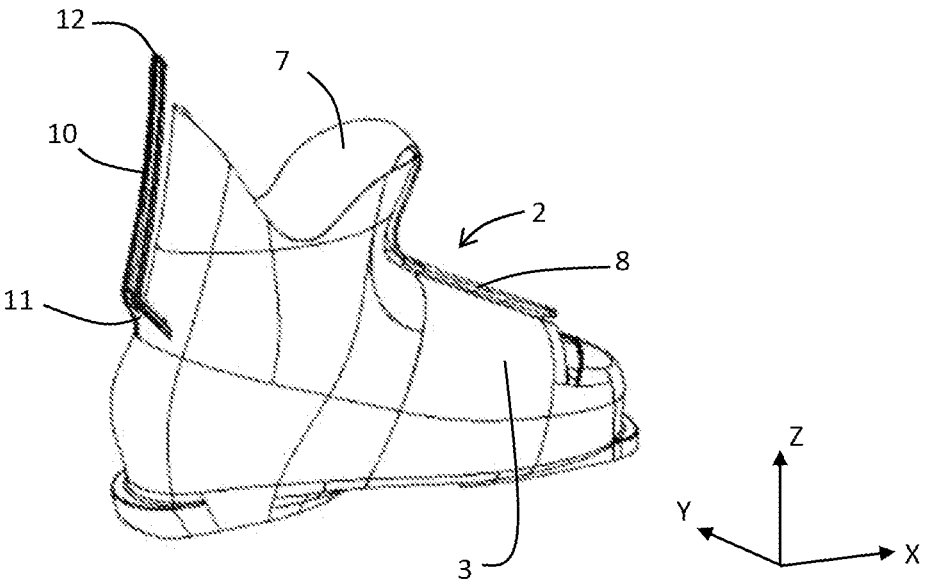
FIG. 4 is a three-dimensional view of a lower shell of the ski boot.

The enveloping part 3, which is also clearly visible in FIGS. 4 and 6, extends upwardly to above the ankles. It comprises an upper opening 7 allowing the foot to be inserted inside the lower shell. This upper opening 7 is extended on the top of the foot by a longitudinal opening 8 which can be closed by means of closure devices (not shown), such as, for example, one or more tightening buckles. Two lateral flaps, positioned on either side of the longitudinal opening 8, can thus be superimposed on the top of the foot, in particular in order to ensure sealing of the gliding boot.

Figure 3:
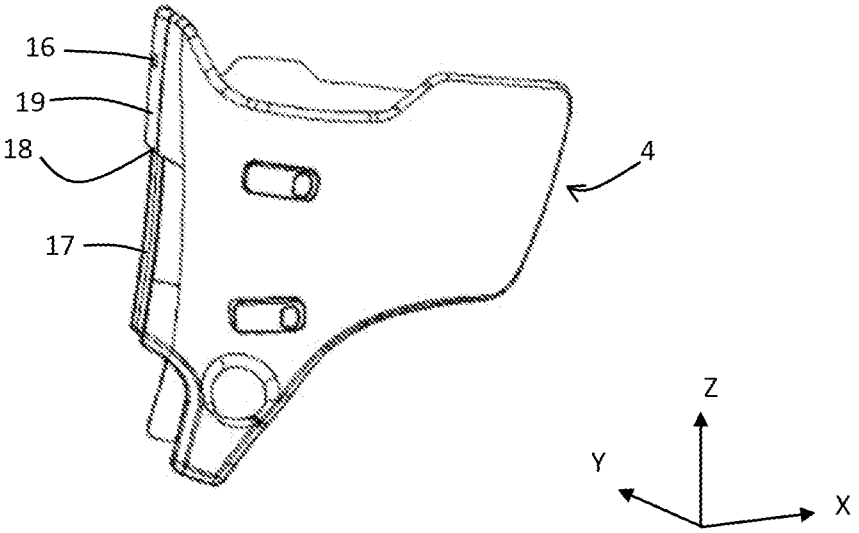
FIG. 3 is a three-dimensional view of a collar of the ski boot.

The collar 4, which is clearly visible in FIG. 3, has a generally tubular shape. It comprises two lateral flaps 9 intended to overlap at the front of the lower part of the leg, substantially at the level of the tibia. The collar 4 can also comprise closure means capable of immobilizing the two lateral flaps 9 in order to enclose the lower part of the leg, for example one or more tightening buckles. The collar 4 extends downwards substantially to the height of the ankles and it extends upwards substantially to the mid-height of the tibia or to one-thirds of the height of the tibia. The rotational connection between the collar and the lower shell can be realized by means of pins extending parallel to the axis Y1. These pins are able to cooperate with openings made in walls of the lower shell 2 and of the collar 4, at the level of each of the ankles of the user.

The collar and the lower shell can preferably be made of plastic, in particular of injection-moulded plastic. For example, they can be made of polyurethane. Advantageously, the collar and the lower shell can be made from the same plastics material. The plastics material and the thickness of the walls forming the collar and the lower shell are chosen so as to protect the foot and so as to provide the gliding boot with a stiffness suitable for the practice of the gliding sport in question. In a variant, any other material can be envisaged to form the lower shell and/or the collar. The plastics material can be filled, in particular with glass or carbon fibres. It is also possible for the collar and/or the lower shell to be formed by an assembly of a plurality of materials obtained, for example, by injection overmoulding, two-shot injection moulding or else co-injection moulding. Preferably, the material constituting the collar and the lower shell is not a foam (that is to say a material filled with air or gas bubbles). Advantageously, the plastics material comprises a bending modulus of between 100 and 500 Mpa, preferably of between 100 and 300 Mpa.

The gliding boot may further comprise a comfort liner (not shown) inserted inside the lower shell and the collar. The comfort liner makes it possible to avoid direct contact between the foot or the lower part of the leg of the user on the one hand and the lower shell and the collar on the other hand.

The lower shell 2 comprises a tongue 10 which is monobloc with the enveloping part 3. What is to be understood by "monobloc" is that the tongue 10 and the enveloping part 3 form one and the same piece. The tongue 10 and the enveloping part therefore form a monolithic assembly, as opposed to an assembly formed by assembling two separate parts. When the lower shell is manufactured by plastic injection moulding, the enveloping part and the tongue can be obtained during the same injection-moulding operation. The retention of the tongue on the enveloping part is obtained by virtue of the cohesion of the plastics material.

According to a variant embodiment, it will be possible for the tongue 10 not to be a tongue which is monobloc with the enveloping part 3. It could in particular be a longitudinal element fastened, for example screwed, to the enveloping part 3.

The tongue 10 is connected to the rear wall 5 of the enveloping part 3 via a lower end 11 of the tongue 10. The tongue therefore extends substantially to the rear of the lower shell 2. The connection between the tongue and the lower shell is positioned substantially at the mid-height of the enveloping part 3. Thus, the tongue is connected to the enveloping part substantially at the height of the ankles, in particular at the height of the axis of articulation between the lower shell and the collar. The connection between the tongue 10 and the enveloping part 3 is positioned substantially at the centre of the rear wall 5, equidistant from the two ankles. Thus, the connection between the tongue 10 and the enveloping part 3 is positioned substantially facing the Achilles tendon of the user. The tongue is arranged outside the enveloping part 3 and is thus not intended to come into contact with the user's foot or with a liner inserted into the enveloping part. As will be seen below, the tongue is intended to cooperate with the collar 4, in particular via its upper end 12.

The tongue 10, which could also be referred to as "strip" or "appendage", extends substantially from the rear wall 5 of the enveloping part 3 and upwards. It extends substantially parallel to the rear wall 5, and therefore mainly parallel to the vertical axis Z. A space 13 can thus be defined between the rear wall 5 of the enveloping part and the tongue 10. A dimension of this space 13, that is to say the distance separating the tongue 10 from the rear wall 5, can be, for example, between 2 mm and 15 mm. This space 13 can be substantially constant over the height of the tongue 10 facing the rear wall 5. It is possible for the tongue 10 not to extend perfectly vertically. Advantageously, it can be generally forwardly inclined by an angle A1 of between 5° and 20° with respect to the vertical axis Z.

The tongue 10 extends upwards above the enveloping part 3 in order to cooperate with the collar 4. The upper end 12 of the tongue is therefore positioned above the upper opening 7 of the enveloping part 3. The tongue comprises a generally rectangular shape. A height H of the tongue, measured along its main direction of extent, can be between 5 cm and 20 cm. A width L of the tongue, measured along the transverse axis Y, can be between 5 mm and 30 mm. In a variant, the rear tongue could be of generally trapezoidal shape, in particular wider at its lower end 11 than at its upper end 12.

The tongue 10 is intended to cooperate with the collar to produce a return force of the collar with respect to the enveloping part 3. The tongue thus makes it possible to modify the rebound characteristics of the boot. More precisely, the tongue is connected to the collar so as to bend when the collar pivots forwards with respect to the enveloping part. The tongue comprises mechanical characteristics such that it generates a return force on the collar, tending to return the collar to the vertical position, as opposed to a more forwardly inclined position. The tongue 10 thus makes it possible to improve the rebound characteristics of the boot. It will be understood that the tongue is an elastic tongue. It is capable of supporting forward bending whose amplitude is determined by the bending amplitude of the collar about the lower shell, without breaking or without undergoing permanent deformation. Note that the tongue 10 may not be elastically deformable, or may be very slightly elastically deformable, in the direction in which it extends, that is to say in the vertical direction.

Figure 5:
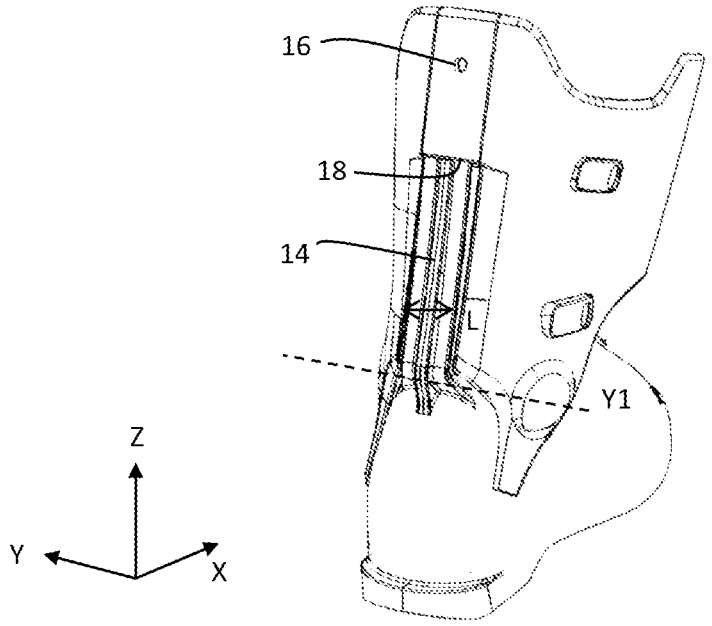
FIG. 5 is a rear view of the ski boot.

As is clearly visible in FIG. 5, the tongue 10 comprises a stiffening rib 14 which can extend over the entire height of the tongue. The rib 14 is arranged vertically at the centre of the tongue and projects rearwards. The rib comprises a decreasing thickness as it runs along the tongue from bottom to top. Such a rib shape gives the tongue bending properties that lead to excellent rebound of the boot being obtained. The rebound characteristics of the boot may be modified by adapting the dimensions of the tongue, in particular its length, and/or its thickness and/or the dimensions of the stiffening rib, and/or its anchoring point on a wall of the lower shell. The decreasing profile of the stiffening rib can also be modified in order to modify the behaviour of the boot.

Figure 2:
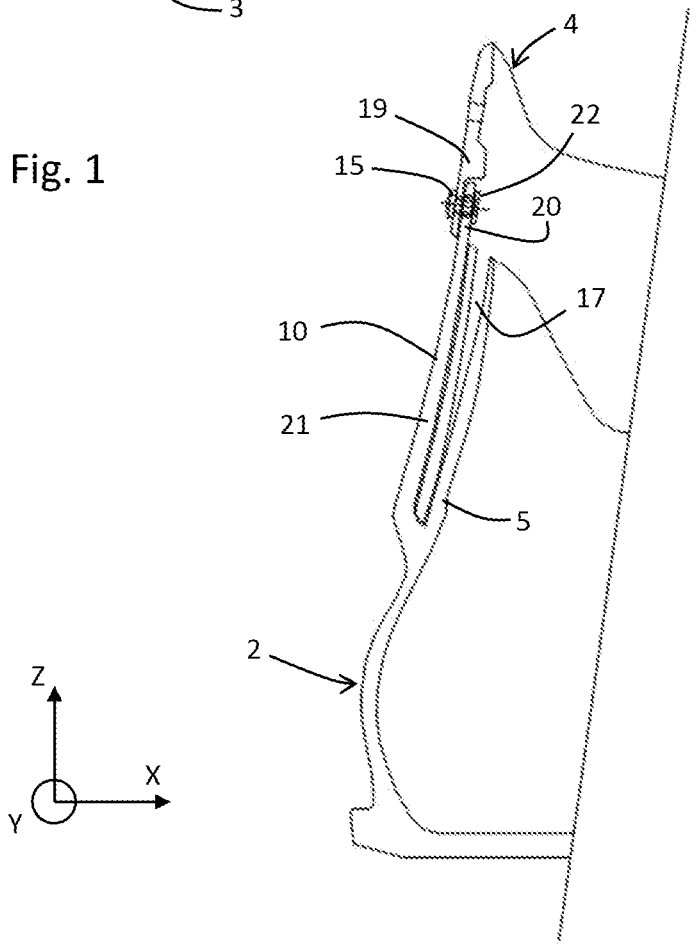
FIG. 2 is a partial view of the ski boot of FIG. 1 in a section in a longitudinal and vertical plane.

The tongue 10 is preferably fastened directly or indirectly to the collar 4. According to the embodiment illustrated in FIG. 2, the fastening of the tongue to the collar is produced by means of a fastening screw 15 passing through a hole formed at the upper end 12 of the tongue 10, and a hole 16 formed at the rear of the collar. The fastening screw 15 cooperates with a connecting part 22, such as a nut, positioned from the inside of the collar. Advantageously, the connecting part 22 can comprise a tubular portion positioned through the holes provided in the tongue and in the collar and also a thread able to cooperate with the fastening screw 15. The tubular portion makes it possible to avoid direct contact between the thread of the fastening screw and the edges of the holes provided in the tongue and in the collar. The fastening screw extends substantially parallel to the longitudinal axis X. An upper portion of the collar is thus retained on the lower shell via the tongue. Note that this connection does not block the rotational articulation of the collar with respect to the enveloping part 3 of the lower shell, since the tongue 10 is capable of bending. Furthermore, it is possible to provide a hole in the tongue having a larger dimension than the diameter of the fastening screw 15 passing through it. This makes it possible to allow a certain relative movement between the tongue and the collar during the inclination of the collar. Moreover, the materials constituting the lower shell and the collar, which are preferably made of plastic, are able to deform. Thus, the inclination of the collar with respect to the enveloping part is also made possible by the deformation of the materials constituting the boot.

The collar further comprises a rear wall 17 covered by the tongue 10. This rear wall 17 has a substantially planar shape and is positioned inside the space 13 defined between the rear wall 5 of the enveloping part 3 and the tongue 10. The rear wall 17 of the collar therefore covers the rear wall 5 of the enveloping part, thereby forming a chicane making it possible to prevent snow from entering the boot. The collar also comprises an opening 18 into which the upper end 12 of the tongue 10 is inserted. The opening 18 is positioned above the rear wall 17 and below the hole 16. An upper portion 20 of the tongue is thus covered by a second rear wall 19 of the collar overlying the first rear wall 17. The space between the two walls 17 and 19 forms a housing for receiving the upper end 12 of the tongue. By covering the upper end of the tongue a situation is prevented in which the latter catches on any object and interferes with the user in terms of his movements. Only a lower portion 21 of the tongue 10 is not covered by the collar and is made visible from outside the boot.

In order to manufacture the ski boot, it is possible, on the one hand, to manufacture a lower shell comprising the enveloping part and the tongue as one and the same piece by plastic injection moulding. On the other hand, it is also possible to manufacture the collar by plastic injection moulding. The lower shell and the collar are then assembled to one another: the end of the tongue is inserted into the opening 18, followed by installing the rotational articulation of the collar about the lower shell and securing the tongue to the collar via the hole 16.

When using the boot, for example for the practice of alpine skiing, the user alternates between bending and extension movements of his legs. When he bends his legs, the collar is inclined forwards with respect to the enveloping part by pivoting about the axis Y1. This pivoting results in bending of the tongue 10. The elasticity of the tongue produces a force which tends to oppose the forward pivoting of the collar. Then, when the user relaxes his legs, the collar returns rearwards, into a more vertical position. The force produced by the tongue facilitates this return into position and relieves the user. The user's muscles are less stressed during the extension phase of the legs, thereby making it possible to better prepare for the following bending phase. Moreover, the return force produced by the tongue makes it possible to maintain tibial pressing on the collar throughout the bending and the extension movement of the leg, which is necessary for good guiding of the gliding boards. The user thus benefits from an improved rebound effect in relation to the use of conventional ski boots. The boot thus allows guiding of the skis that is dynamic, precise and without effort.

The rebound of a boot can be characterized by a laboratory test in which the boot is immobilized by its lower shell, which is positioned flat on the ground, and then the collar is pulled forwards. Then, the collar is relaxed and returns naturally to its initial position. An accelerometer is installed so as to measure the acceleration of the rearward travel of the collar. The rebound can then be quantified as a function of the acceleration measured. Tests carried out on a boot according to the invention show that the rebound can be improved by approximately 40% with respect to an identical boot without a tongue.

The invention is not limited to the embodiment described and variants can be envisaged. For example, the tongue is not necessarily connected to the collar by an embedment-type connection. The tongue could be connected to the collar using a sliding connection. It can, for example, be simply inserted into the opening 18 and free to slide inside this opening parallel to the direction in which the tongue extends. Thus, when the collar is inclined forwards, the tongue comes into contact with the rear wall 19 of the collar. By reaction of the wall 19 of the collar on the tongue, the latter produces a return force towards the rear that tends to straighten the collar.

The tongue can be fastened to the collar in various ways; for example via a single screw as has been described or via a plurality of screws. The tongue can comprise a plurality of holes able to cooperate with one or more screws so as to define a more or less pronounced inclination of the collar with respect to the lower shell. The fastening screw 15 can be replaced by any equivalent fastening means, in particular a rivet, a pin or a clip. According to another variant embodiment, the tongue 10 could also be welded or adhesively bonded to the collar.

Figure 7:
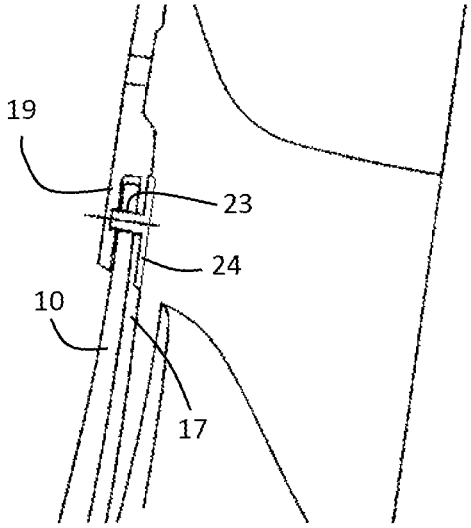
FIG. 7 is a partial view of a ski boot in a section in a longitudinal and vertical plane and according to a first variant embodiment of the invention.

According to a first variant embodiment, illustrated in FIG. 7, the fastening means making it possible to fasten the tongue to the collar can be arranged in such a way as to be invisible from outside the boot. According to this variant embodiment, the hole 16 is arranged in the rear wall 17 of the collar and is extended by a blind hole in the second rear wall 19 of the collar. The hole 16 therefore does not open onto the outer face of the collar. The fastening means comprises a lug 23 passing through the hole 16 and through the hole formed in the tongue, and also a head 24 arranged on the rear wall 17 side of the collar. Advantageously, a counterbore can be provided on the inner face of the wall 17 to receive the head 24 so as not to generate a protuberance on the surface of the wall 17. The fastening means can be fastened to the rear wall 17 of the collar by screwing, for example. The lug 23, passing through the hole in the tongue 10, retains this tongue 10 so as to immobilize it during forward flexing of the boot.

Advantageously, an elastic means 26 can be interposed between the tongue 10 and the collar 4. This elastic means 26 can be configured so as to exert an elastic return force oriented substantially parallel to the direction in which the tongue 10 extends, that is to say in a substantially vertical direction. Such an elastic means further improves the rebound of the ski boot while providing a durable connection means between the tongue 10 and the collar 4.

Figure 8:
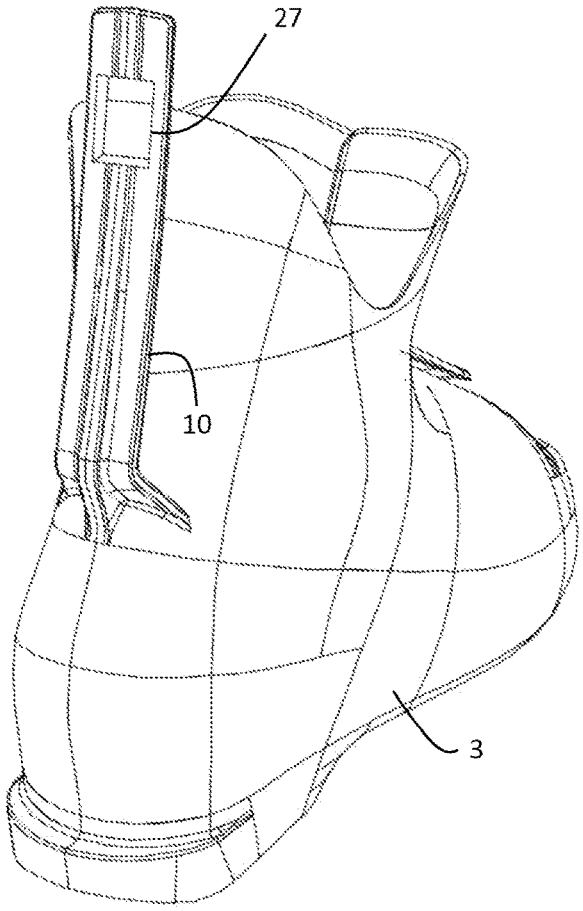
FIG. 8 is a perspective view of a lower shell of a ski boot according to a second variant embodiment of the invention.
Figure 9:
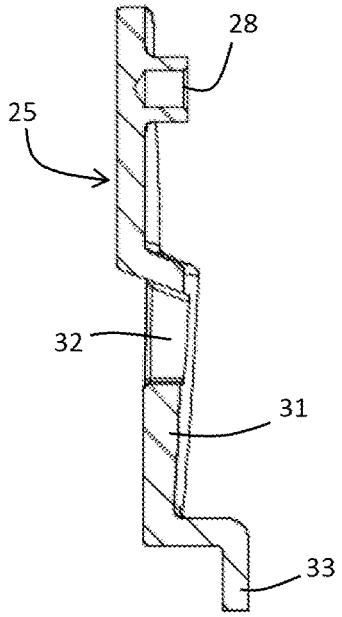
FIG. 9 is a view in section of an insert of the ski boot according to the second variant embodiment of the invention.
Figure 10:
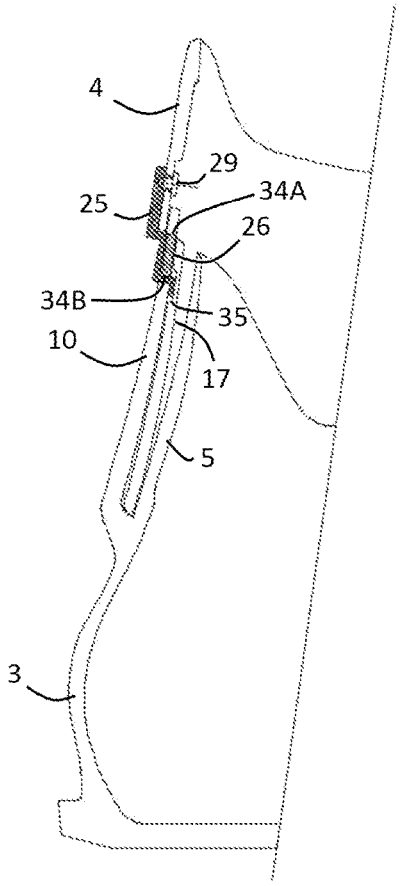
FIG. 10 is a partial view of the ski boot according to the second variant embodiment of the invention in a section in a longitudinal and vertical plane.

In particular, according to a second variant embodiment, illustrated in FIGS. 8, 9 and 10, the tongue 10 is connected to the collar 4 via an insert 25 and the elastic means 26. The tongue 10 comprises an opening 27 in the upper part, for example of rectangular shape, in which the elastic means 26 is positioned. As can be seen in FIG. 10, the elastic means 26 comprises a first end 34A bearing on an upper edge of the opening 27 and a second end 34B bearing on the insert 25. The elastic means 26 is configured to be elastically compressed between its two ends 34A, 34B when the collar 4 is bent forwards. In particular, the elastic means 26 is configured to be elastically compressed in the axis along which the tongue 10 extends, that is to say substantially vertically.

The elastic means 26 is preferably an elastomer element, in particular an elastomer block of substantially rectangular shape. In a variant, the elastic means 26 could comprise one or more springs, such as, for example, leaf springs or helical springs. The elastomer type and/or the thickness of the elastomer element can be adapted in order to obtain the desired return force. The elastic means can, in a variant, be configured to work in tension, and not in compression. Note that the elastic means 26 can optionally produce only a small return force when it is loaded in bending.

Figure 11:
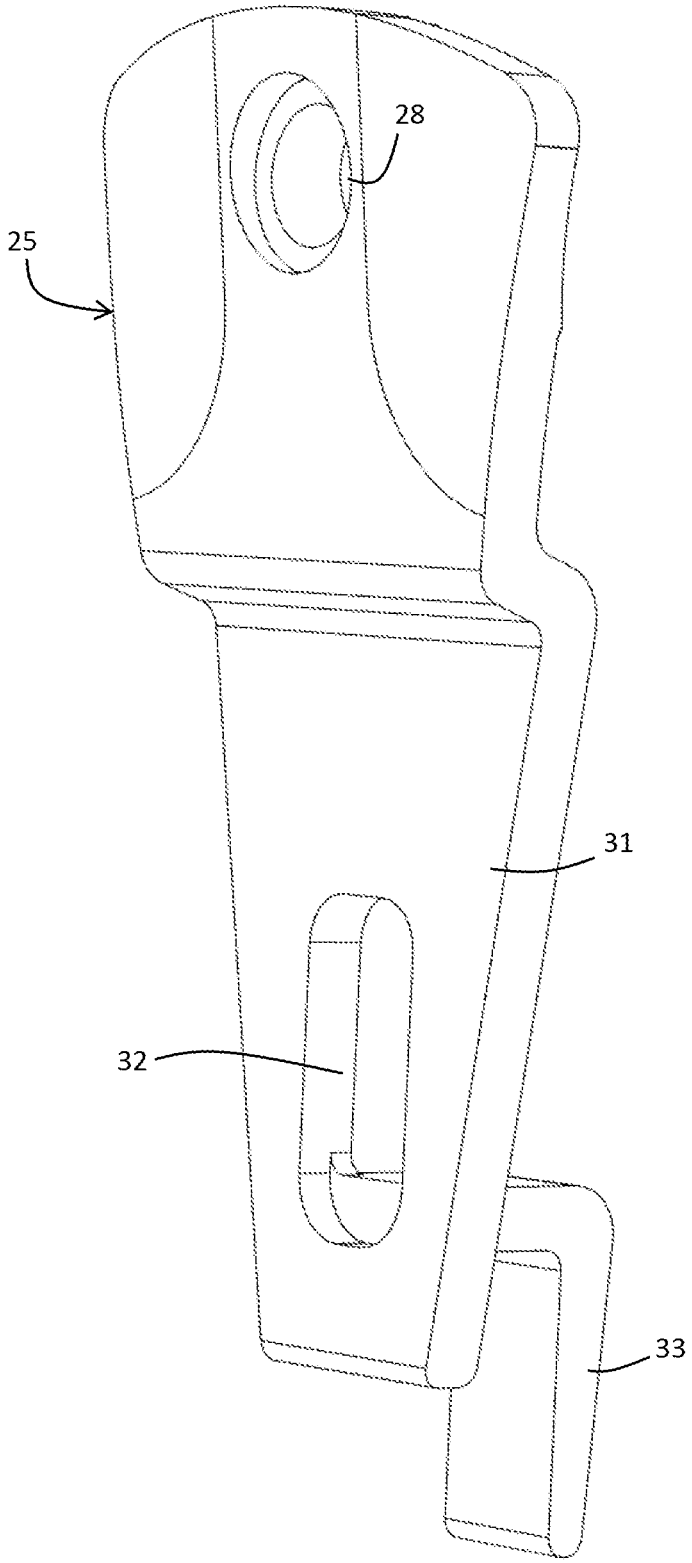
FIG. 11 is a perspective view of an insert of the ski boot according to another variant of the invention.

The insert 25 can be a metal part or, in a variant, a plastic part. It comprises a lower end bearing against the second end 34B of the elastic means and an upper end by which it is fastened to the collar 4. In particular, the insert 25 comprises a tapped opening 28 at its upper end. This tapped opening 28 cooperates with a fastening screw 29 and a hole provided in the collar 4 in order to fasten the insert 25 to the collar 4. According to a variant embodiment, the insert 25 could be fastened differently: it could, for example, be riveted, adhesively bonded or welded to the collar. According to another variant embodiment represented on the FIG. 11, the opening 28 could be a through opening cooperating with a fastening screw and a nut (not represented). The screw head could be positioned on the outer side of the ski boot and the nut could be positioned on the inner side of the ski boot. The nut can be blocked or fixed inside a recess on the inner face of the collar. According to another variant embodiment, the insert 25 could be fastened to the collar in a removable manner such that the user of the ski boot could temporarily remove the connection between the tongue 10 and the collar 4 while skiing. This would allow him to temporarily cancel the rebound effect produced by the tongue 10 and the elastic means 26. According to yet another variant embodiment, the insert 25 could be formed integrally with the collar 4, that is to say that the collar and the insert would form one and the same piece. In other words, the collar could then be in contact with or bear directly against the elastic means 26.

The elastic means 26 is retained in position in the opening 27 of the tongue. Thus, the integration of the elastic means 26 does not increase the size of the ski boot and the elastic means is protected from impacts and from snow. This retention in position can be obtained, on the one hand, by means of the insert 25 which prevents the elastic means 26 from escaping rearwards and, on the other hand, by the rear wall 17 of the collar 4, which is inserted between the tongue 10 and the rear wall 5 of the lower shell 2, and which prevents the elastic means 26 from escaping forwards. The elastic means 26 can thus be held captive between two walls, thereby allowing it to maintain its position in the opening 27 of the tongue 10. A wall 31 of the insert 25 therefore extends vertically along the elastic means 26, to the rear of the latter. This wall 31 can comprise an opening 32 so as to make the elastic means 26 visible from outside the ski boot. The elastic means 26 can also be connected to the insert in a fixed or movable manner. According to a variant embodiment, the elastic means 26 could be adhesively bonded against the wall 31 of the insert.

Advantageously, the insert 25 is clipped into the opening 27 of the tongue, which makes it possible to maintain an optimum bearing surface between the insert 25 and the elastic means 26. More particularly, the insert 25 comprises, at its lower end, an offset 33, or appendage 33, which is inserted into the opening 27 and bears against a front face of the tongue 10 below the opening 27. The offset 33 is not fastened to the lower shell 2. Relative sliding between this offset 33 and the lower shell can therefore be established when the collar 4 is bent forwards. Advantageously, the length of the offset 33 is sufficient to keep the insert 25 clipped in the opening 27 even under maximum forward bending of the collar. A counterbore 35 can be provided in the rear wall 17 of the collar to receive the offset 33.

Assembling such a ski boot is straightforward: all that is required is to position the insert 25 and the elastic means 26 in the opening 27 and then to screw the fastening screw 29 into the tapped opening 28 by passing it through the hole provided in the collar. Then, when the user skis with this boot, the forward bending of the collar is accompanied, on the one hand, by bending of the tongue 10, which bends forwards, and, on the other hand, by a compression of the elastic means 26, in the axis of the tongue.

During the forward bending of the collar 4, the insert 25 is translated upwards with respect to the tongue 10, thereby compressing the elastic means 26 in the opening 27. There then occurs a relative movement between the upper end of the tongue 10 and the collar 4. These two deformations are elastic deformations and participate in a complementary manner to the rebound effect produced by the ski boot.

Furthermore, the elastic means 26 makes it possible to maintain the fastening of the insert 25 to the collar 4 and, in a general manner, the connection between the tongue 10 and the collar 4. Specifically, by virtue of the presence of the elastic means 26, the shear forces at this connection (in particular at the fastening screw 29 and the tapped opening 28) are reduced.

It would also have been possible for the fastening of the insert 25 to be inverted, with the insert being fastened to the tongue and connected to the collar via the elastic element.

Moreover, the lower shell can be completely made up of injection-moulded plastics material. In a variant, it can also comprise inserts, in particular metal inserts aimed at stiffening certain parts of the lower shell. A metal insert can, for example, be provided inside the tongue to increase the stiffness thereof. The lower shell can also be formed by the combination of various plastics materials, for example by means of plastic co-injection moulding, injection overmoulding or two-shot injection moulding.

The boot may further additionally comprise flex adjustment means, that is to say means for adjusting the resistance to forward flexing of the boot. These adjustment means can be obtained by means of fastening screws passing through the enveloping part and the collar, in particular at the rear walls 5 and 17.

The above-described boot comprises a single tongue extending from the rear of the boot. In a variant, it could comprise a plurality of similar tongues. The boot could comprise, for example, two tongues positioned on either side of a longitudinal median plane of the boot, each of these tongues being connected to the collar.

The tongue or the tongues extends or extend generally upwards so as to connect the enveloping part to the collar which overlies it. What is to be understood by "upwards" is that the tongue can be oriented in any direction making it possible to provide the connection between the enveloping part and the collar. Depending on the position of the anchoring points of the tongue or tongues on the lower shell and on the collar, the tongue or the tongues can be inclined to a greater or lesser extent with respect to the vertical axis. For example, the tongue or the tongues can be inclined up to an angle of approximately 30° with respect to the vertical axis, or even up to an angle of approximately 45° with respect to the vertical axis.

Finally, according to another variant embodiment, it would be possible for the tongue not to form a monobloc assembly with the enveloping part, but with the collar. In this case, the tongue would mainly extend downwards from the collar and would cooperate with the lower shell so as to flex consecutively to a forward rotation of the collar. The tongue would then, where appropriate, be fastened to the lower shell and/or inserted via its lower end into an opening provided in the lower shell.

The different variants set out above can be freely combined. By virtue of the invention, a boot is therefore made available that is simple to manufacture, is robust and has optimum rebound characteristics for the practice of gliding sports.

The invention claimed is:

1. A ski boot, comprising:

a lower shell intended to receive a user's foot, the lower shell comprising an enveloping part having a general shape hugging a shape of the user's foot, the enveloping part comprising a rear wall hugging a shape of a heel of the user's foot, a collar intended to envelop a lower leg of the user, the collar being articulated in rotation about the lower shell, an upwardly extending tongue at a rear of the gliding boot, and an elastic means, wherein a first end of the tongue forms a fastened assembly or a monobloc assembly with the lower shell, the tongue extends substantially parallel to the rear wall, a space being defined between the tongue and the rear wall, and a second end of the tongue is connected to the collar via the elastic means.

2. The ski boot according to claim 1, wherein the elastic means is configured to produce an elastic return force in a direction in which the tongue extends.

3. The ski boot according to claim 1, wherein the elastic means is configured to be elastically compressed when the collar pivots forwards with respect to the lower shell.

4. The ski boot according to claim 1, wherein the elastic means is an elastomer element.

5. The ski boot according to claim 1, wherein the tongue comprises an opening, the elastic means being positioned inside the opening.

6. The ski boot according to claim 1, wherein the gliding boot comprises an insert at the rear of the gliding boot, the insert is fastened directly to the collar, and the elastic means comprise a first end bearing on the tongue and a second end bearing on the insert.

7. The ski boot according to claim 6, wherein the tongue comprises an opening, the elastic means is positioned inside the opening, and the insert is clipped into the opening.

8. The ski boot according to claim 1, wherein the tongue is configured to be bent elastically when the collar pivots forwards with respect to the lower shell.

9. The ski boot according to claim 1, wherein the tongue and the lower shell are made of a same material.

10. The ski boot according to claim 1, wherein the tongue forms a monobloc assembly with the lower shell.

11. The ski boot according to claim 1, wherein the tongue forms a fastened assembly with the lower shell.

12. The ski boot according to claim 1, wherein the tongue is configured to flex when the collar pivots forwards relative to the lower shell.

* * * * *